US008007129B2

(12) United States Patent
Yang

(10) Patent No.: US 8,007,129 B2
(45) Date of Patent: Aug. 30, 2011

(54) LED-BASED CHRISTMAS LIGHT STRING ASSEMBLY WITH PARALLEL-WIRED LIGHTING UNITS

(76) Inventor: Chen-Sheng Yang, Kaohsiung (TW)

( * ) Notice: Subject to any disclaimer, the term of this patent is extended or adjusted under 35 U.S.C. 154(b) by 140 days.

(21) Appl. No.: 12/453,796

(22) Filed: May 22, 2009

(65) Prior Publication Data

US 2010/0296290 A1 Nov. 25, 2010

(51) Int. Cl.
*F21S 4/00* (2006.01)

(52) U.S. Cl. ..... 362/249.06; 362/391; 315/185 S

(58) Field of Classification Search ..... 362/652, 362/653, 654, 391, 249.06; 315/185 S
See application file for complete search history.

(56) References Cited

U.S. PATENT DOCUMENTS

| | | | | |
|---|---|---|---|---|
| 4,223,248 | A * | 9/1980 | Tong | 315/185 S |
| 6,994,452 | B2 * | 2/2006 | Rozenberg et al. | 362/183 |
| 7,301,287 | B1 * | 11/2007 | Lu | 315/185 R |
| 7,508,141 | B2 * | 3/2009 | Wong | 315/185 S |
| 2004/0233668 | A1 * | 11/2004 | Telfer et al. | 362/252 |
| 2005/0286255 | A1 * | 12/2005 | Sugar | 362/391 |
| 2008/0130283 | A1 * | 6/2008 | Chang | 362/249 |

* cited by examiner

*Primary Examiner* — Jong-Suk (James) Lee
*Assistant Examiner* — Peggy A. Neils
(74) *Attorney, Agent, or Firm* — Bacon & Thomas, PLLC

(57) ABSTRACT

An LED light string assembly has a plug for providing a low DC voltage, an extension socket, a light string connected between the plug and the extension socket. The light string has multiple LED Christmas bulbs connected in parallel. Each LED Christmas bulb includes an LED and a resistor connected in series. Even one of the LED Christmas bulb burns out, all the remaining LED Christmas bulb of the light string will not be affected and still can be normally turned on as required to generate light.

2 Claims, 5 Drawing Sheets

LED-BASED CHRISTMAS LIGHT STRING ASSEMBLY WITH PARALLEL-WIRED LIGHTING UNITS

BACKGROUND OF THE INVENTION

1. Field of the Invention

The present invention relates to a LED-based Christmas light string assembly, and more particularly to a LED-based Christmas string assembly with parallel-wired lighting units.

2. Description of Related Art

With reference to FIGS. 4 and 5, a conventional light string comprises a plug (50), an extension socket (52), multiple light emitting diodes (LEDs) (54) connected between the plug (50) and the extension socket (52) in series. The plug (50) has two conductive contacts (501) for electrically connecting an AC voltage (60). The extension socket (52) has two slots (521) for correspondingly connecting to a plug of a subsequent LED light string. However, when any one of the light emitting diodes (LEDs) (54) becomes inoperable and causes an open circuit, the remaining light emitting diodes (LEDs) (54) of the string cannot be normally activated to generate light. The entire light string will not light until the failure one is replaced.

To overcome the shortcomings, the present invention provides an LED-based Christmas light string assembly with parallel-wired lighting units to mitigate or obviate the aforementioned problems.

SUMMARY OF THE INVENTION

The main objective of the present invention is to provide a LED-based Christmas string assembly with parallel-wired lighting units to ensure that most of the lighting units can be normally activated as required when any one of the lighting unit burns out.

To accomplish the objective, the LED light string assembly has a plug for providing a low DC voltage, an extension socket, a light string connected between the plug and the extension socket. The light string has multiple LED Christmas bulbs connected in parallel. Each LED Christmas bulb includes an LED and a resistor connected in series. Even one of the LED Christmas bulb burns out, all the remaining LED Christmas bulb of the light string will not be affected and still can be normally turned on as required to generate light.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
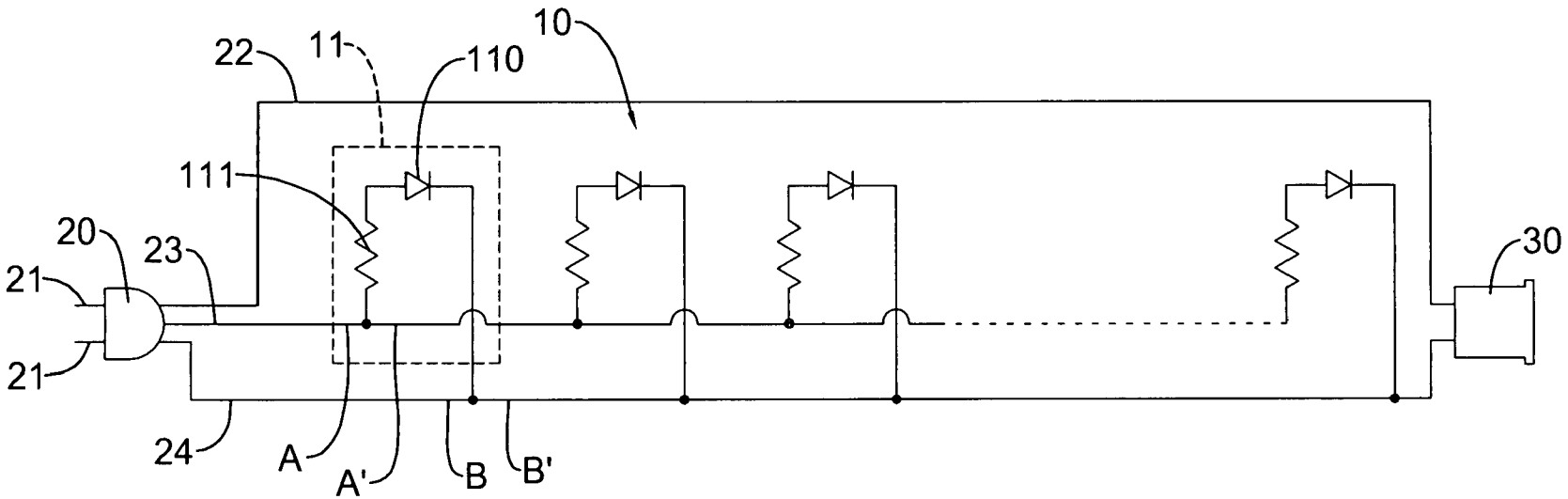
FIG. 1 is a circuit diagram of a LED-based light string assembly with parallel-wired lighting units in accordance with the present invention.
Figure 2:
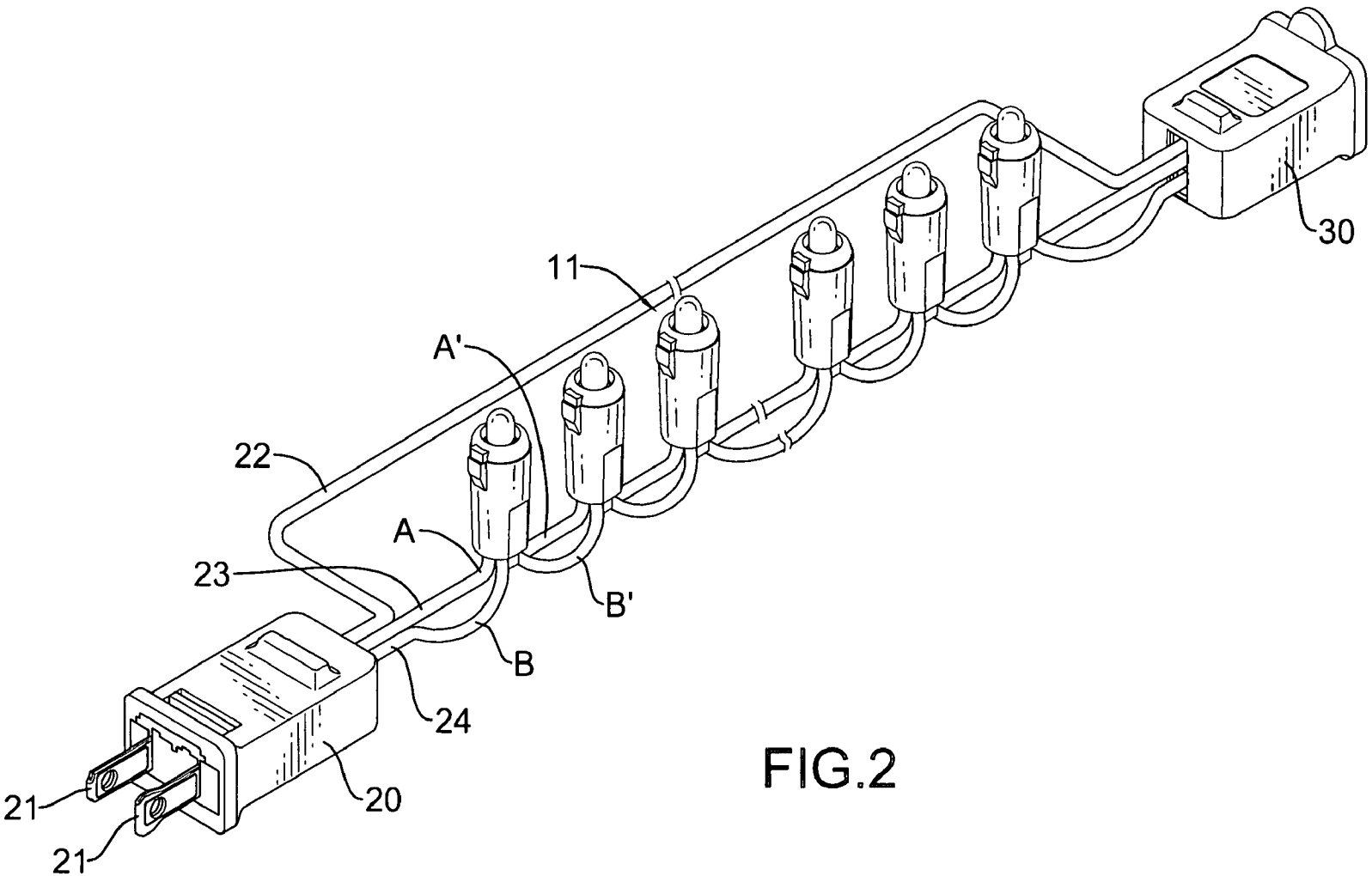
FIG. 2 is a perspective view of the LED-based light string assembly of FIG. 1.

With reference to FIGS. 1 and 2, a LED-based Christmas light string assembly in accordance with the present invention comprises a light string (10), a plug (20) and an extension socket (30)

The plug (20) has two contacts (21) for electrically receiving an AC voltage and is integrated with an AC/DC converting circuit to convert the received AC voltage to a low DC voltage for driving the light string (10). The plug (20) further connects to three wires including an extension wire (22), a DC voltage output wire (23) and a ground wire (24). The extension wire (22) is connected to the extension socket (30) and conducts the low voltage from the plug (20) to the extension socket (30). The DC voltage output wire (23) is connected to the light string (10) and transmits the low DC voltage to the light string (10).

The light string (10) comprises multiple lighting units (11) connected in parallel between the DC voltage output wire (23) and the ground wire (24). Each lighting unit (11) includes an LED Christmas bulb (110) and a resistor (111) connected in series. The resistor (111) can limit the current flowing through the LED Christmas bulb (110) to protect it from burning out. Furthermore, when the LED Christmas bulb (110) itself occurs a short circuit, the resistor (111) connected to the failure LED Christmas bulb (110) can avoid a short circuit between the DC voltage output (23) and the ground wire (24) to ensure that remaining LED Christmas bulbs (110) can generate light and be operated normally.

Figure 3:
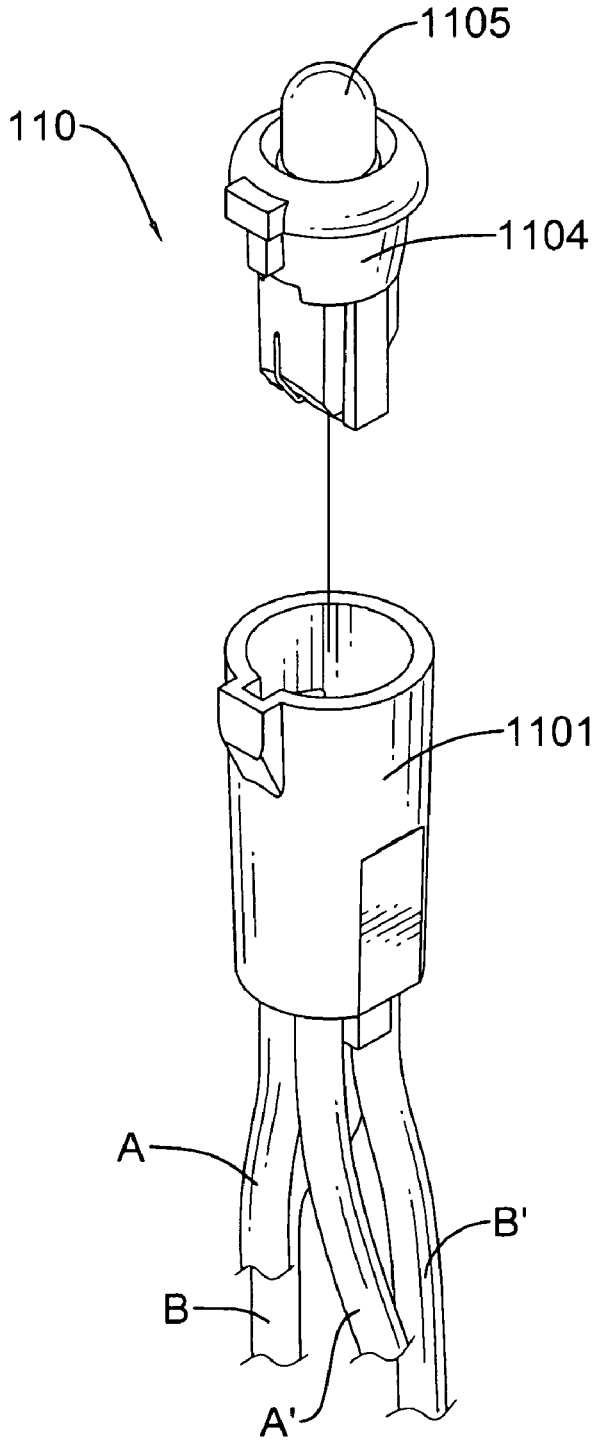
FIG. 3 is an exploded perspective view a LED Christmas bulb in accordance with the present invention.
Figure 4:
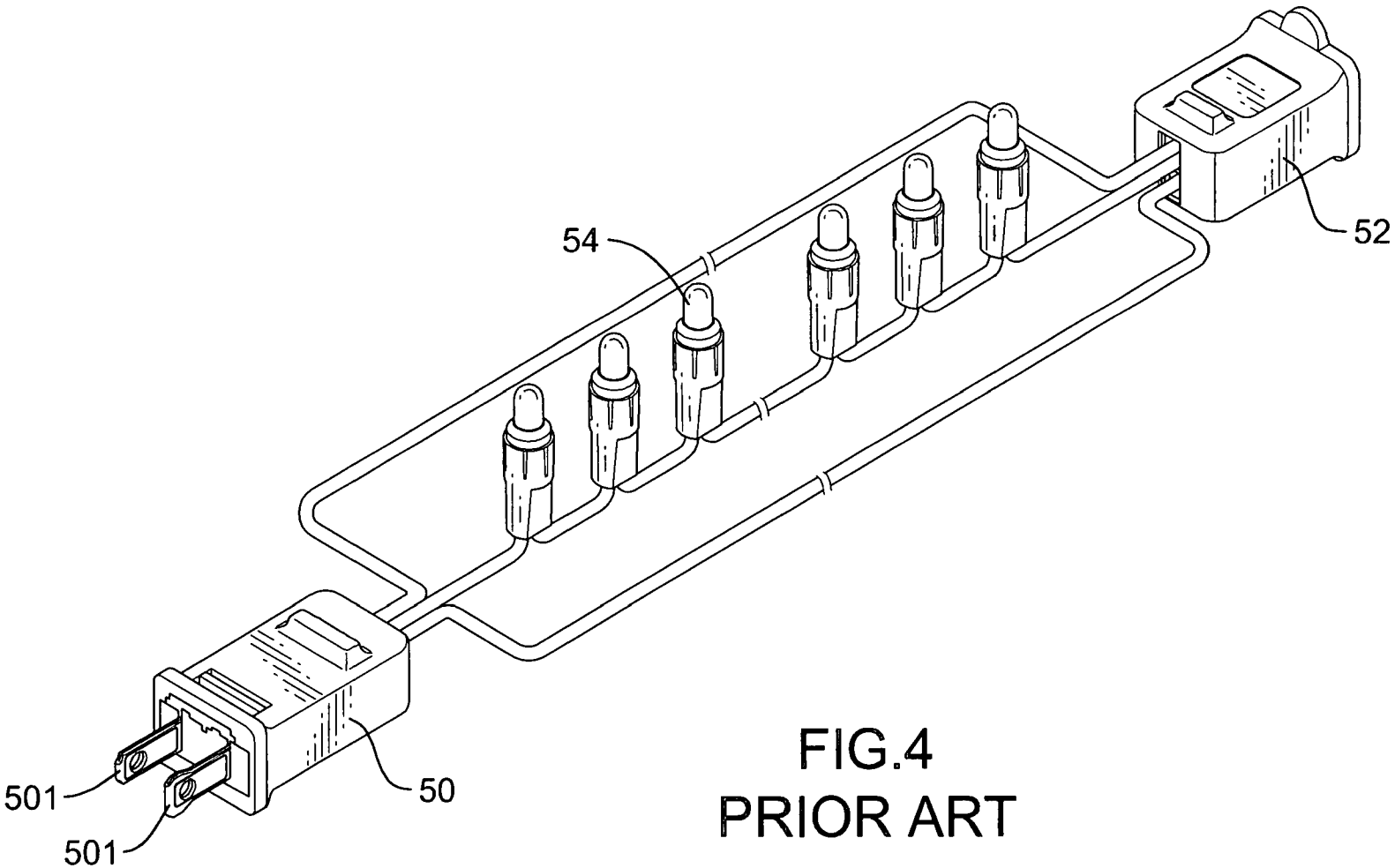
FIG.4 PRIOR ART
FIG. 4 is a perspective view of a conventional light string.
Figure 5:
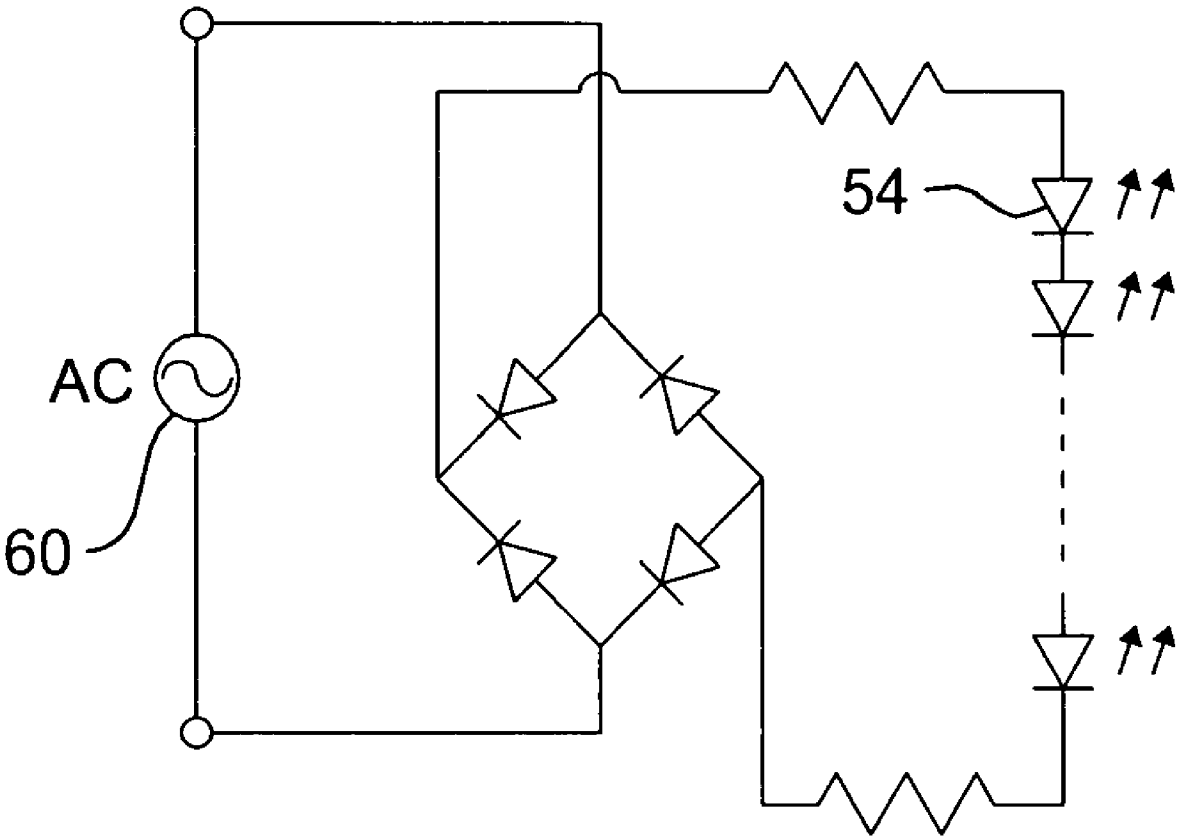
FIG. 5 is an equivalent circuit of the conventional light string of FIG. 4.

With further reference to FIG. 3, each LED Christmas bulb (110) comprises a socket (1101) with two pairs of conductive wires (A,A')(B,B'), a base (1104) and an LED (1105) with two terminals.

When assembling the LED Christmas bulb (110), the LED (1105) is mounted in the base (1104) with the two terminals protruding through the base (1104), and the base (1104) is held in the socket (1101). The two terminals of the LED (1105) contact two internal conductive plates within the socket (1101) respectively. The two internal conductive plates are connected to the two pairs of the conductive wires (A,A') (B,B") respectively. For the first pair of the conductive wires (A,A') of each LED Christmas bulb (110), one wire (A) is connected to either the DC voltage output wire (23) or the wire (A') of a preceding LED Christmas bulb (110) to receive the output DC voltage, and other wire (A') is connected to ground wire (24) or the wire (A) of a next LED Christmas bulb (110).

The extension socket (30) is connected to the light string (10), the extension wire (22) and the ground wire (24) for further connecting to another subsequent light string.

With the parallel-wired configuration, even one of the LED Christmas bulb (110) burns out, all the remaining LED Christmas bulb (110) will not be affected and can be normally turned on to generate light.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A LED-based Christmas light string assembly with parallel-wired lighting units, the assembly comprising:

a plug receiving an AC voltage, converting the AC voltage to a low DC voltage and connected with an extension wire, a DC voltage output wire and a ground wire, wherein the extension wire and the DC voltage output wire transmit the low DC voltage;

an extension socket connected to the extension wire and the ground wire;

a light string being connected between the plug and the extension socket, and comprising multiple lighting units connected in parallel, each lighting unit having an LED Christmas bulb and a resistor connected in series, each resistor limiting a current flowing through the corresponding LED Christmas bulb and preventing a short circuit between the DC voltage output wire and the ground wire when the corresponding LED Christmas bulb becomes short circuit.

2. The LED-based Christmas light string assembly as claimed in claim 1, wherein each LED Christmas bulb comprises:

a socket having a first pair and a second pair of conductive wires, the first pair of the conductive wires receiving the low DC voltage, the second pair of the conductive wires connected to the ground wire;

a base mounted in the socket;

a LED mounted in the base and having two terminals protruding from the base to electrically and respective connect to the first pair and the second pair of the conductive wires.

* * * * *